US011052659B2

(12) United States Patent
Nishii

(10) Patent No.: US 11,052,659 B2
(45) Date of Patent: Jul. 6, 2021

(54) LIQUID DISCHARGE APPARATUS

(71) Applicant: BROTHER KOGYO KABUSHIKI KAISHA, Nagoya (JP)

(72) Inventor: Kazuhiro Nishii, Suzuka (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 22 days.

(21) Appl. No.: 16/565,674

(22) Filed: Sep. 10, 2019

(65) Prior Publication Data

US 2020/0101737 A1 Apr. 2, 2020

(30) Foreign Application Priority Data

Sep. 28, 2018 (JP) ..... JP2018-185891

(51) Int. Cl.
*B41J 2/14* (2006.01)

(52) U.S. Cl.
CPC ..... *B41J 2/14201* (2013.01)

(58) Field of Classification Search
CPC B41J 2/14201; B41J 2/14233; B41J 2/14459; B41J 2/14241
See application file for complete search history.

(56) References Cited

U.S. PATENT DOCUMENTS

| | | | | |
|---|---|---|---|---|
| 9,688,076 | B2 * | 6/2017 | Sugahara | B41J 2/17509 |
| 2007/0109364 | A1 | 5/2007 | Ito | |
| 2007/0263038 | A1 | 11/2007 | Bibl | |
| 2008/0030554 | A1 | 2/2008 | Sugahara | |
| 2011/0242185 | A1 | 10/2011 | Watanabe | |
| 2014/0043388 | A1 | 2/2014 | Yoshimura et al. | |
| 2014/0146116 | A1 | 5/2014 | Pashkewitz | |
| 2018/0022085 | A1 | 1/2018 | Ishizaki | |
| 2018/0086084 | A1 | 3/2018 | Kimura | |

FOREIGN PATENT DOCUMENTS

| | | | |
|---|---|---|---|
| EP | 2 287 006 | A1 | 2/2011 |
| EP | 2 287 006 | A8 | 2/2011 |
| EP | 3 299 149 | A1 | 3/2018 |
| JP | 2011-136462 | A | 7/2011 |
| WO | WO 2012/165378 | A1 | 12/2012 |

OTHER PUBLICATIONS

Extended European Search Report dated Feb. 26, 2020 of related European Patent Application No. 19 19 6785.0.

* cited by examiner

*Primary Examiner* — Thinh H Nguyen
(74) *Attorney, Agent, or Firm* — Scully, Scott, Murphy & Presser, P.C.

(57) ABSTRACT

There is provided a liquid discharge apparatus including: a discharging member including a plurality of individual electrodes arranged side by side in a first direction, a plurality of individual channels arranged side by side in the first direction, a plurality of nozzles arranged side by side in the first direction, a common channel communicating with the plurality of individual channels, and an opening communicating with the common channel; and a heating member at least a part of which makes contact with the discharging member. An individual electrode, included in the plurality of individual electrodes and located at an end in the first direction, and the opening are apart from each other in the first direction. At least the part of the heating member is a part making contact with the discharging member, at a location between the opening and the individual electrode located at the end in the first direction.

16 Claims, 19 Drawing Sheets

LIQUID DISCHARGE APPARATUS

CROSS REFERENCE TO RELATED APPLICATION

The present application claims priority from Japanese Patent Application No. 2018-185891 filed on Sep. 28, 2018, the disclosure of which is incorporated herein by reference in its entirety.

BACKGROUND

Field of the Invention

The present technique relates to liquid discharge apparatuses configured to discharge or jet a liquid which includes, for example, an ink.

Description of the Related Art

Conventionally, there is a publicly known a liquid droplet discharge apparatus including a channel member formed with a common channel which is communicated with a plurality of nozzles, and a reservoir formed with a channel via which a liquid is supplied to the channel member. The liquid droplet discharge apparatus forms an image by discharging (jetting) an ink from the nozzles onto a recording medium which includes, for example, paper (paper sheet). The reservoir of the liquid droplet discharge apparatus is provided with a heat conducting part extending in a longitudinal direction of the reservoir. The heat is conducted to the liquid from the heat conducting part whereby the temperature, viscosity, etc., of the liquid is/are adjusted.

During a period of time in which the liquid moves from the reservoir up to the nozzles while passing through the common channel, the temperature of the liquid is lowered, which in turn leads to such a fear that the viscosity of the liquid might be increased.

The present disclosure is made in view of the above-described situation, and an object thereof is to provide a liquid discharge apparatus capable of appropriately controlling the temperature, viscosity, etc., of the liquid discharged from the nozzles.

SUMMARY

According to an aspect of the present disclosure, there is provided a liquid discharge apparatus including: a head and a heater. The head includes: a plurality of individual electrodes arranged side by side in a first direction, a plurality of individual channels arranged side by side in the first direction, a plurality of nozzles arranged side by side in the first direction, a common channel communicating with the plurality of individual channels, and an opening communicating with the common channel. The heater makes contact with the head. A first individual electrode, which is included in the plurality of individual electrodes and which is located at an end in the first direction, and the opening are apart from each other in the first direction. The heater includes a contacting part which makes contact with the head at a location between the first individual electrode and the opening in the first direction.

In the liquid discharge apparatus according to the present disclosure, the heating member makes contact with the discharging member, at the location between the opening and an individual electrode which is included in the plurality of individual electrodes and which is located at the end in the first direction, and the heating member heats heat the liquid in the vicinity of the individual electrode, thereby making it possible to appropriately adjust the temperature, the viscosity, etc., of the liquid.

DESCRIPTION OF THE EMBODIMENTS

First Embodiment

Figure 1:
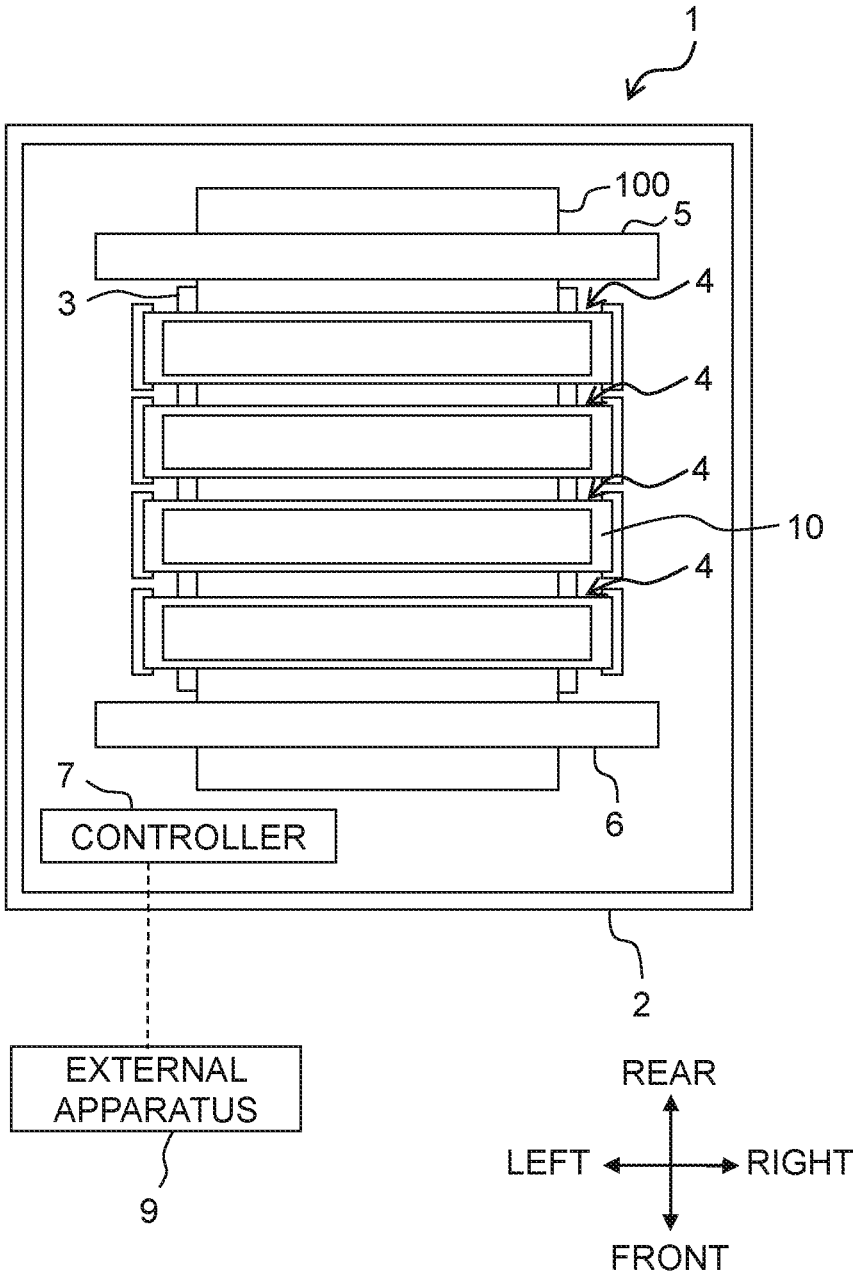
FIG. 1 is a plan view of a printer 1.

In the following, an explanation will be given based on the accompanying drawings depicting a printer 1 according to a first embodiment. In FIG. 1, a conveyance direction of recording paper 100 (recording medium) corresponds to a front-rear direction of the printer 1. Further, a width direction of the recording paper 100 corresponds to a left-right direction of the printer 1. Further, a direction orthogonal to the front-rear direction and the left-right direction, namely, a direction orthogonal to the sheet surface of FIG. 1 corresponds to an up-down direction of the printer 1.

As depicted in FIG. 1, the printer 1 includes a platen 3 accommodated in a casing 2, four ink jet heads 4, two conveying rollers 5 and 6, a controller 7, etc.

The recording paper 100 is placed on the upper surface of the platen 3. The four ink jet heads 4 are arranged side by side in the conveyance direction at a location above the platen 3. Each of the ink jet heads 4 is a so-called line-type head. An ink is supplied to the ink jet heads 4 from a non-depicted ink tank. Inks of different colors are supplied to the four ink jet heads 4, respectively.

As depicted in FIG. 1, the two conveying rollers 5 and 6 are arranged respectively at the rear side and at the front side with respect to the platen 3. Each of the two conveying rollers 5 and 6 is driven by a non-depicted motor to convey the recording paper 100 on the platen 3 frontward.

The controller 7 includes an FPGA (Field Programmable Gate Array), an EEPROM (Electrically Erasable Programmable Read-Only Memory), a RAM (Random Access Memory), etc. Further, the controller 7 may further include a CPU (Central Processing Unit) or ASIC (Application Specific Integrated Circuit), etc. The controller 7 is connected with an external apparatus 9 such as a PC (Personal Computer), to be communicable manner therewith; the controller 7 controls the respective parts, components, units, etc., of the printer 1 based on print data sent from the external apparatus 9.

Figure 2:
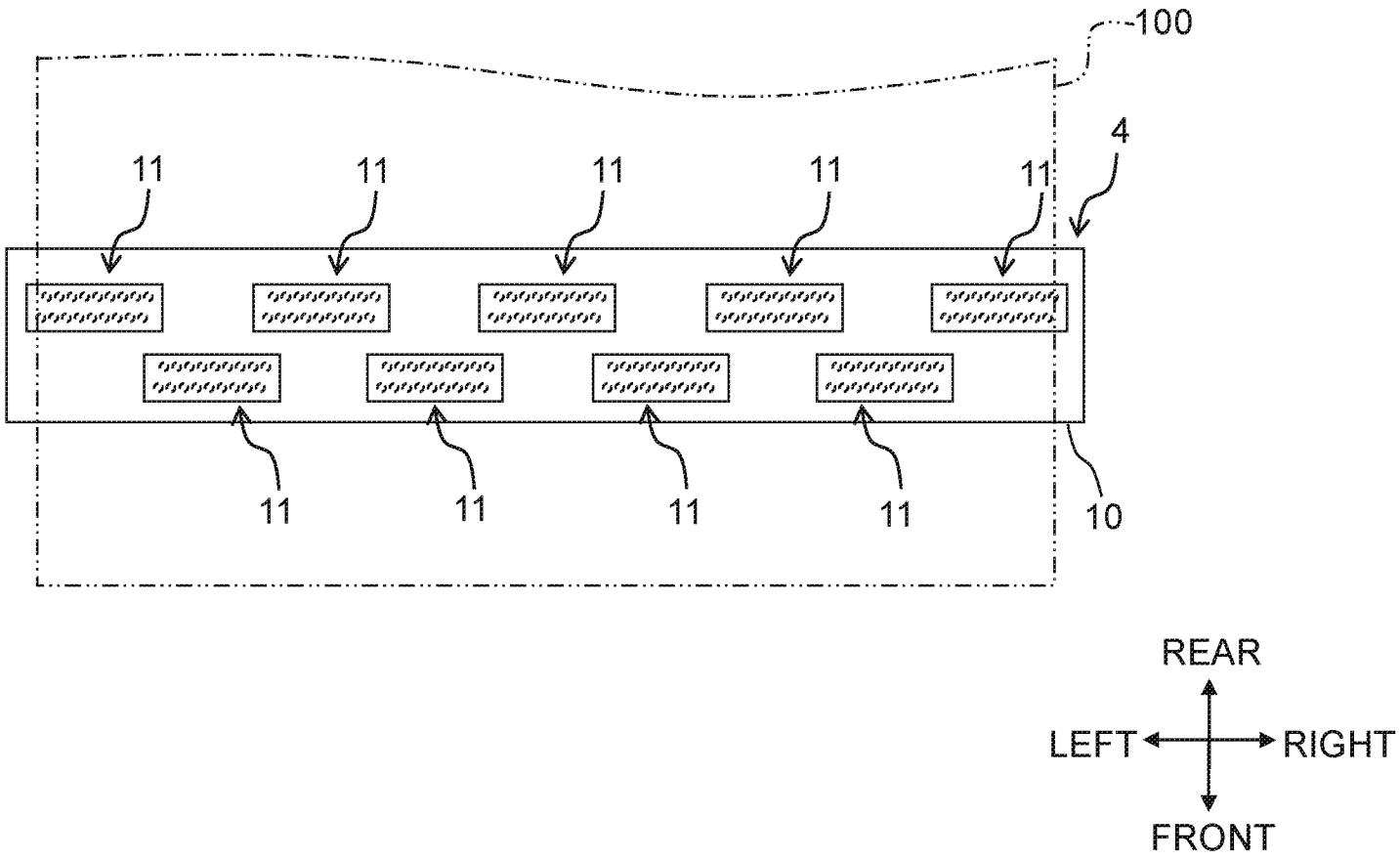
FIG. 2 is a plan view of an ink jet head 4.

As depicted in FIG. 2, the ink jet head 4 includes a plurality of liquid discharge apparatuses 11. The plurality of liquid discharge apparatuses 11 are attached to a holder plate 10 in a staggered alignment. Each of the liquid discharge apparatuses 11 has a plurality of nozzles 30*d* arranged side by side in the left-right direction (see FIG. 6) to form a nozzle row. Note that since FIG. 2 is a schematic or simplified plan view, the number of nozzle rows in FIG. 2 is different from that of FIG. 9.

The controller 7 controls the motor which drives each of the two conveying rollers 5 and 6 so as to cause the two conveying rollers 5 and 6 to convey the recording paper 100 in the conveyance direction. Further, together with the above-described conveyance of the recording paper 100 by the conveying rollers 5 and 6, the controller 7 controls the four ink jet heads 4 to discharge or jet the inks from the nozzles 30*d* toward the recording paper 100. With this, an image, etc., is printed on the recording paper 100.

An explanation will be given about the configuration of the liquid discharge apparatus 11, with reference to FIGS. 3, 4 and 5. Each of the liquid discharge apparatuses 11 includes a first frame 21 having a rectangular shape in a plan view. The first frame 21 is provided with an opening 21*a* at a central part of the first frame 21. Four through holes 21*b* are arranged side by side in the front-rear direction in a left end part of the first frame 21, penetrating therethrough in the up-down direction.

A heating member 28 is provided inside the opening 21*a*. A plate spring 29 is provided at a location above the heating member 28. The plate spring 29 is formed with two positioning holes 29*a* arranged side by side in the front-rear direction. The two positioning holes 29*a* correspond to two bosses 24*b* (to be described later on), respectively. A control substrate 31 is provided at a location above the plate spring 29. The plate spring 29 biases or urges the control substrate 31 upward. With the plate spring 29, a space is provided between the heating member 28 and the control substrate 31; thus, the plate spring 29 functions as the spacer. The heating member 28 will be described in detail later on.

A second frame 32 having a rectangular shape in a plan view is provided at a location above the first frame 21. An opening 32*a* corresponding to the opening 21*a* of the first frame 21 is provided at a central part of the second frame 32. A support collar 32*c*, which projects toward the center of the opening 32*a*, is provided on the inner circumferential surface of the opening 32*a*. Four through holes 32*b* are arranged side by side in the front-rear direction in a left end part of the second frame 32, penetrating therethrough in the up-down direction, corresponding to the through holes 21*b* of the first frame 21, respectively.

The first frame 21 and the second frame 32 overlap with each other in the up-down direction. The opening 32*a* of the second frame 32 is arranged at a location above the opening 21*a* of the first frame 21, and the through holes 32*b* of the second frame 32 are arranged at a location above the through holes 21*b* of the first frame 21. A sealing member 33 is provided between the first frame 21 and the second frame 32 to thereby seal a gap or interspace between the first frame 21 and the second frame 32 in a liquid tight manner.

The heating member 28 and the control substrate 31 are arranged inside the opening 21*a* of the first frame 21 and inside the opening 32*a* of the second frame 32. A holder collar 34 is provided on the support collar 32*c* of the second frame 32. The support collar 32*c* supports the holder collar 34. A heat sink (radiator plate) 35 is provided inside the holder collar 34. The holder collar 34 supports the heat sink 35. An alignment frame 36 is provided at a location above the heat sink 35 and the second frame 32.

A channel member 30 having a plate-like shape is provided at a location below the first frame 21. An actuator 20 is provided on the upper surface of the channel member 30. The actuator 20 is arranged inside the opening 21*a*.

Figure 6:
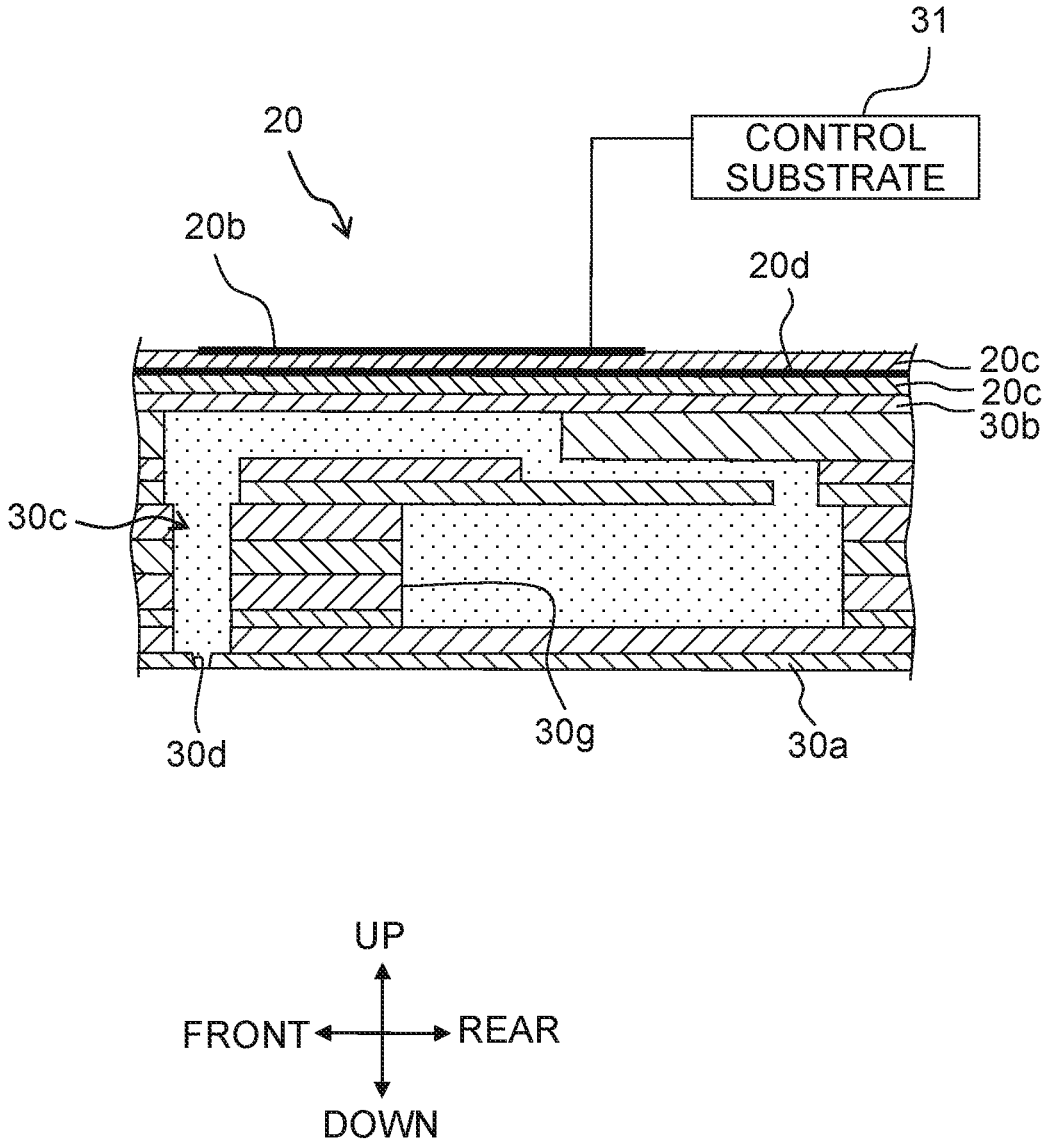
FIG. 6 is a partially enlarged cross-sectional view of an actuator 20 and a channel member 30.

As depicted in FIG. 6, the channel member 30 is constructed of a plurality of plates formed with through holes which define flow channels, respectively. The channel member 30 includes a nozzle plate 30*a* and a vibration plate 30*b*. In the nozzle plate 30*a*, the plurality of nozzles 30*d* are arranged side by side in the left-right direction (the direction orthogonal to the sheet surface of FIG. 6). Pressure chambers 30*c* are formed each at a location above one of the plurality of nozzles 30*d*. The pressure chambers 30*c* are connected or linked to a common channel 30*g* (to be described later on).

The actuator 20 is arranged on the vibration plate 30*b*. The vibration plate 30*b* is provided at a location above the pressure chambers 30*c* to close or block upper openings of the pressure chambers 30*c*. Two piezoelectric layers 20*c* are stacked in the actuator 20. A common electrode 20*d* is provided between the two piezoelectric layers 20*c*. The common electrode 20*d* is constantly kept at the ground potential. The actuator 20 includes a plurality of individual electrodes 20*b* arranged side by side in the left-right direction (first direction). The plurality of individual electrodes 20*b* are provided on a piezoelectric layer 20*c* which is on the upper side among the two piezoelectric layers 20*c*; the plurality of individual electrodes 20*b* are arranged at locations above the plurality of pressure chambers 30*c*, respectively. Each of the plurality of individual electrodes 20*b* is connected with the control substrate 31.

Figure 3:
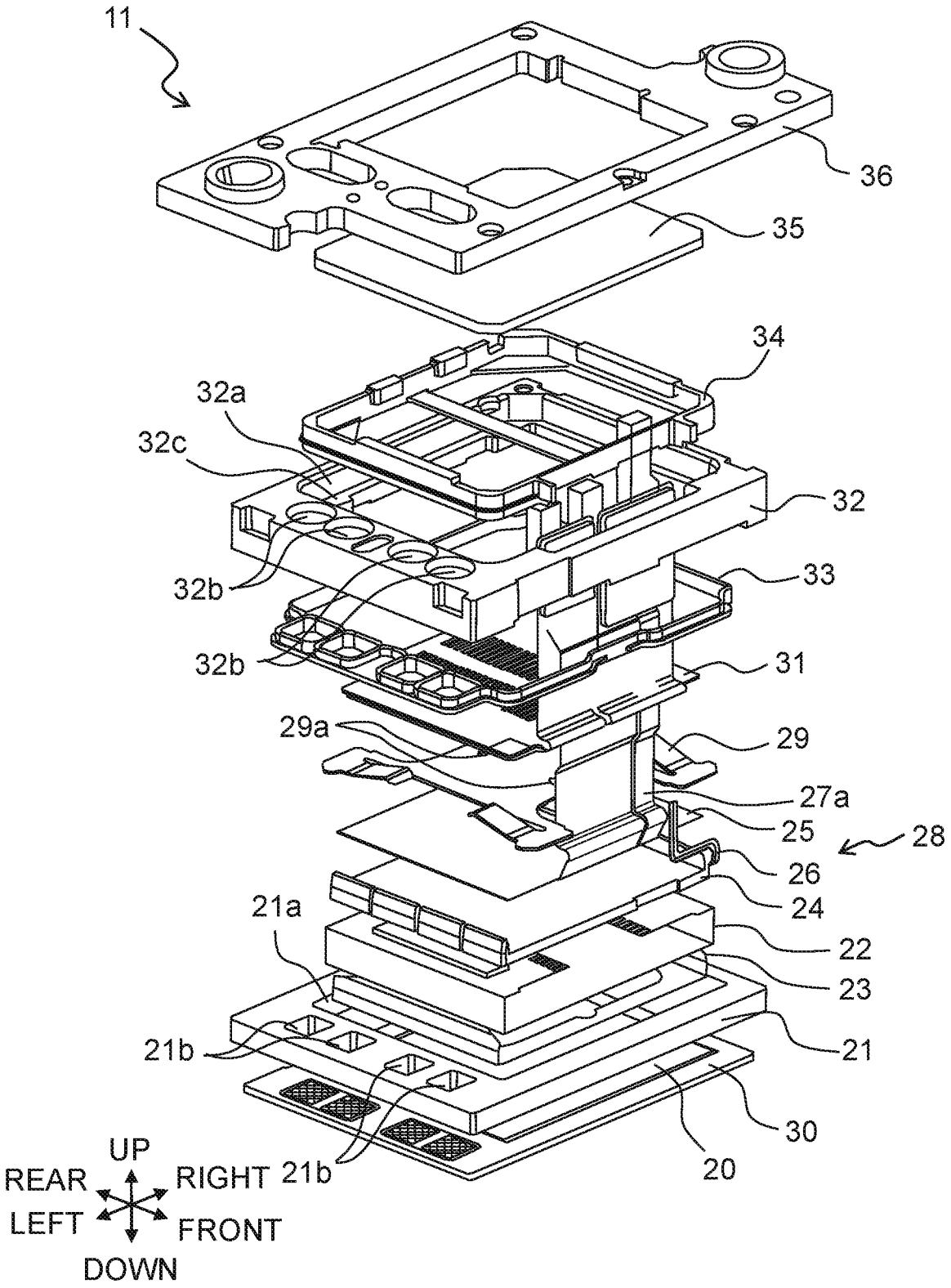
FIG. 3 is an exploded perspective view of a liquid discharge apparatus 11.
Figure 4:
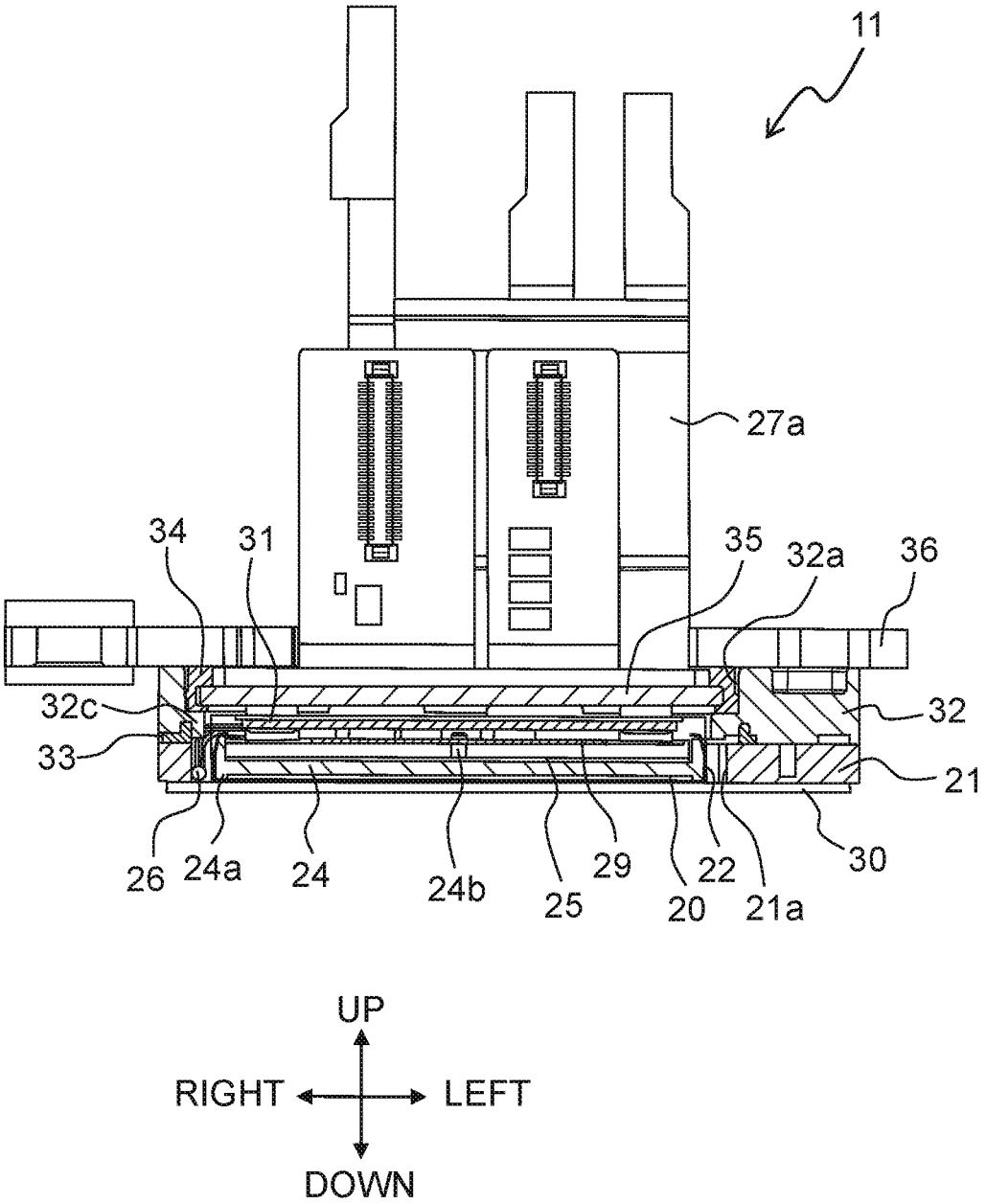
FIG. 4 is a vertical cross-sectional view of the liquid discharge apparatus 11.

As depicted in FIGS. 3 and 4, a COF 22 is joined to the upper surface of the actuator 20 via a joining member 23 having an annular shape in a plan view. The joining member 23 may be exemplified by a double-sided adhesive tape, a sheet-like adhesive, etc. A plurality of contact points, corresponding to the plurality of individual electrodes and to the common electrode, are formed on the upper surface of the actuator 20.

Those plurality of contact points formed on the upper surface of the actuator 20 are joined respectively with a plurality of contact points provided on the COF 22 with bumps. The heating member 28 is provided on the upper surface of the COF 22. The width in the left-right direction of the COF 22 is greater than that of the heating member 28, and a left end part and a right end part of the COF 22 are bent or flexed upward so as to cover a left end part and a right end part of the upper surface of the heating member 28.

Figure 7:
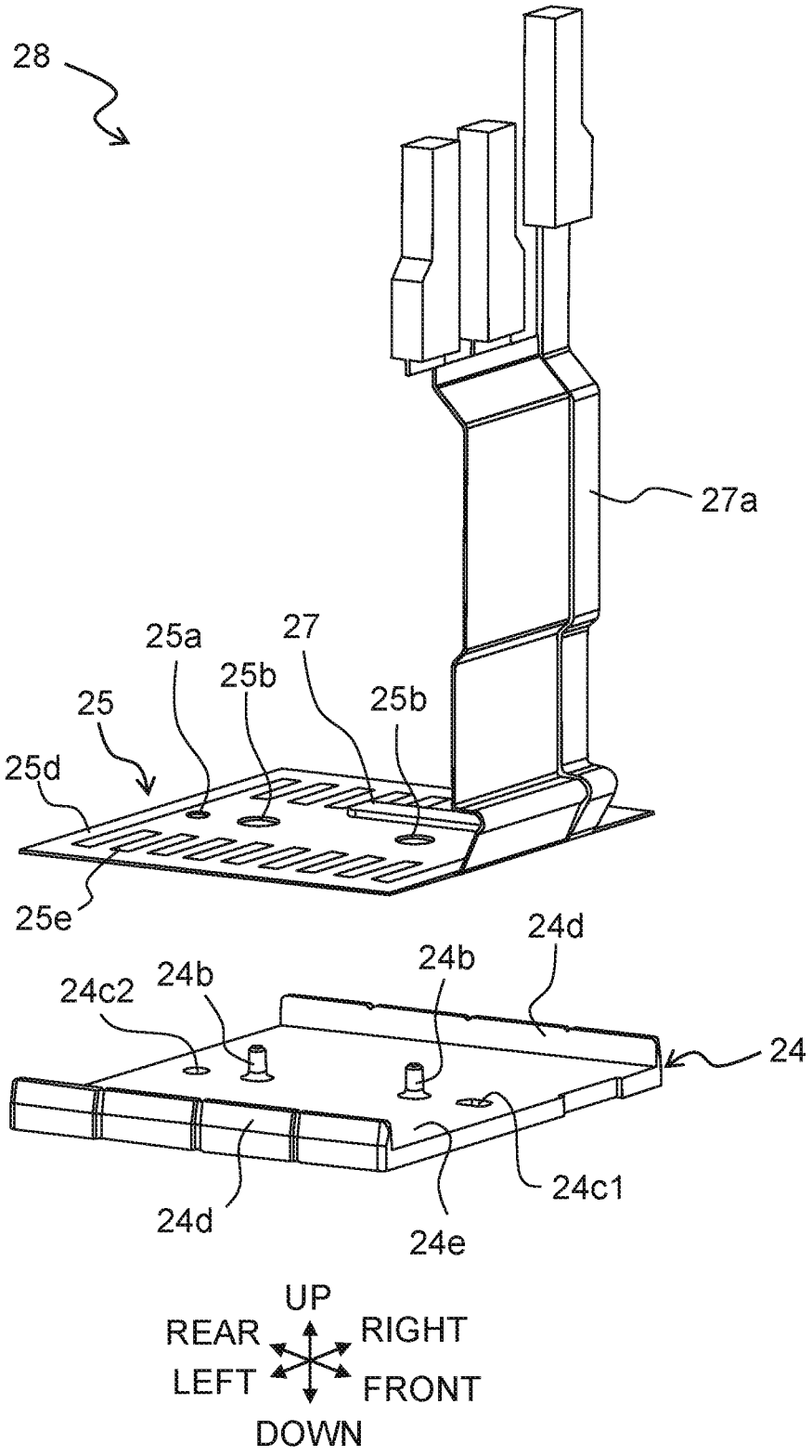
FIG. 7 is an exploded perspective view of a heating member 28.

As depicted in FIG. 7, the heating member 28 includes a body 24 having a plate-like shape, and a film heater 25. The liquid discharge apparatus 11 includes a first thermistor 26 and a second thermistor 27. The body 24 includes a plate part 24*e*; a left edge part and a right edge part of the plate part 24*e* form, respectively, projecting parts 24*d* which project upward. A front edge part and a rear edge part of the plate part 24*e* are respectively formed with through holes 24*c*1 and 24*c*2 which penetrate therethrough in the up-down direction.

The through hole 24*c*1 is a long hole extending in the front-rear direction, whereas the through hole 24*c*2 is a circular hole. The through holes 24*c*1 and 24*c*2 are arranged in a central part in the left-right direction of the plate part 24*e*. The two through holes 24*c*1 and 24*c*2 are used for positioning the body 24 relative to a jig in a process of attaching the joining member 23 to the body 24. The two bosses 24*b* are arranged side by side in the front-rear direction, at a location between the two through holes 24*c*1 and 24*c*2. The bosses 24*b* project upward from the plate part 24*e*. The heat conductivity of the body 24 is higher than the heat conductivity of the channel member 30; for example, the body 24 is constructed of an aluminum member, and the channel member 30 is constructed of a stainless steel member.

The film heater 25 includes a film part 25*d*. The film part 25*d* is formed of a resin such as polyimide, etc. The film part 25*d* is a film formed with two through holes 25*b* penetrating therethrough in the up-down direction so as to correspond to the two bosses 24*b*, respectively. Further, the film part 25*d* is provided with a flow-through hole 25*a* via which the air is allowed to flow, and which corresponds to the through hole 24*c*2 formed in the rear edge part of the plate part 24*e*. Further, the film part 25*d* is formed with heating wires 25*e*. The second thermistor 27 is provided on the upper surface of the film part 25*d*. The second thermistor 27 is capable of measuring the temperature of the film part 25*d*. The second thermistor 27 is connected with the controller 7 via a wiring part 27*a*.

The film heater 25 is provided on the upper surface of the body 24. The two bosses 24*b* are inserted respectively into the two through holes 25*b* so as to project upward from the film part 25*d*, and to be inserted into two positioning holes 29*a* of the plate spring 29. By inserting the bosses 24*b* into the positioning holes 29*a*, the positions in the front-rear direction and in the left-right direction of the plate spring 29 is determined.

The flow-through hole 25*a* is arranged at a location above the through hole 24*c*2, and thus the through hole 24*c*2 is not closed or blocked by the film part 25*d*. Therefore, the air can flow through the flow-through hole 25*a* and the through hole 24*c*2. On the other hand, the through hole 24*c*1 is closed or blocked by the film part 25*d*. Any heating wire 25*e* is not arranged in a part or portion, of the film part 25*d*, which is positioned above the through hole 24*c*1. Even in such a case that a heating wire 25*e* is arranged in the part, of the film part 25*d*, which is positioned above the through hole 24*c*1, namely, in the part, of the film part 25*d*, which closes or blocks the opening of the through hole 24*c*1, the heat generated in that part cannot be conducted or transferred to the body 24. By not arranging any heating wire 25*e* in the part, of the film part 25*d*, which is positioned above the through hole 24*c*1, it is possible to prevent any wasteful consumption of the electric power.

The first thermistor 26 is arranged on the upper surface of the channel member 30, and detects the temperature of the channel member 30. The first thermistor 26 is connected to the controller 7. The controller 7 controls the supply of electric current to the heating wires 25*e*, based on the temperatures detected by the first thermistor 26 and the second thermistor 27, respectively.

Figure 5:
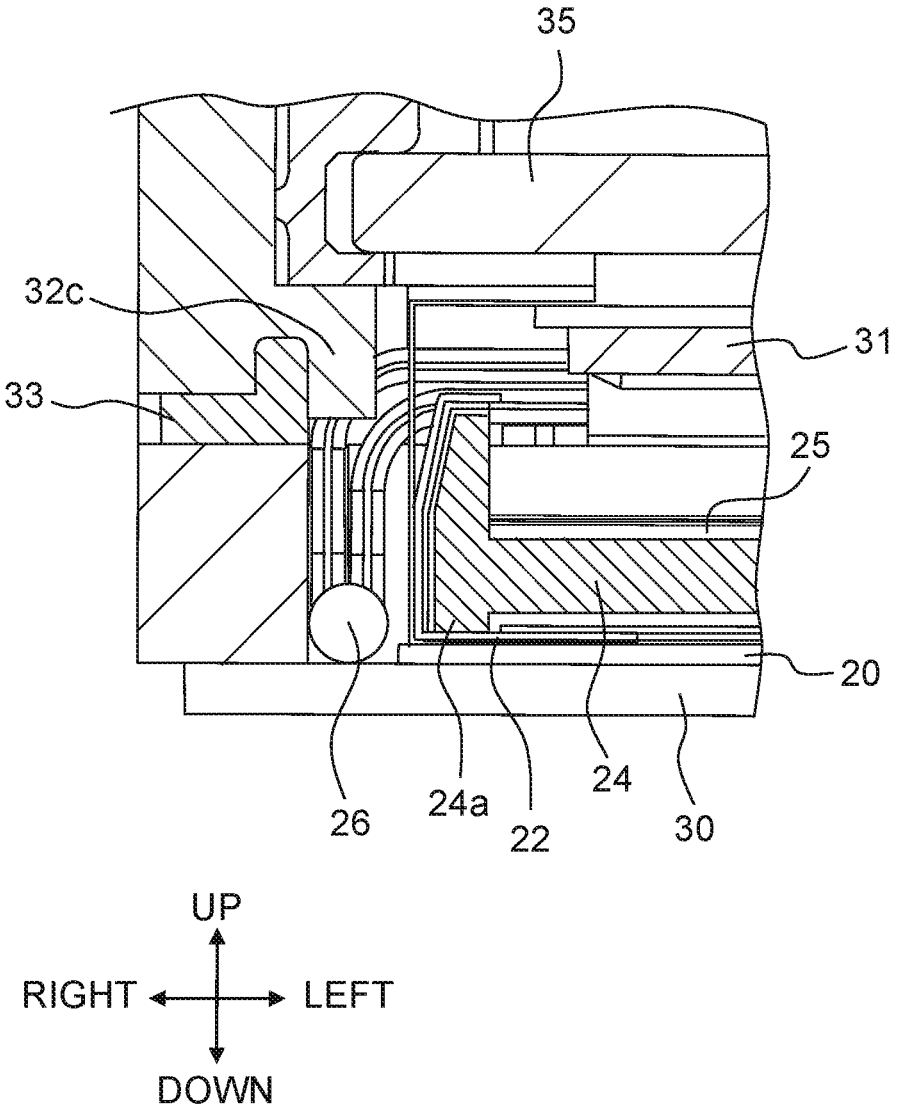
FIG. 5 is a partially enlarged vertical cross-sectional view of the liquid discharge apparatus 11.
Figure 8:
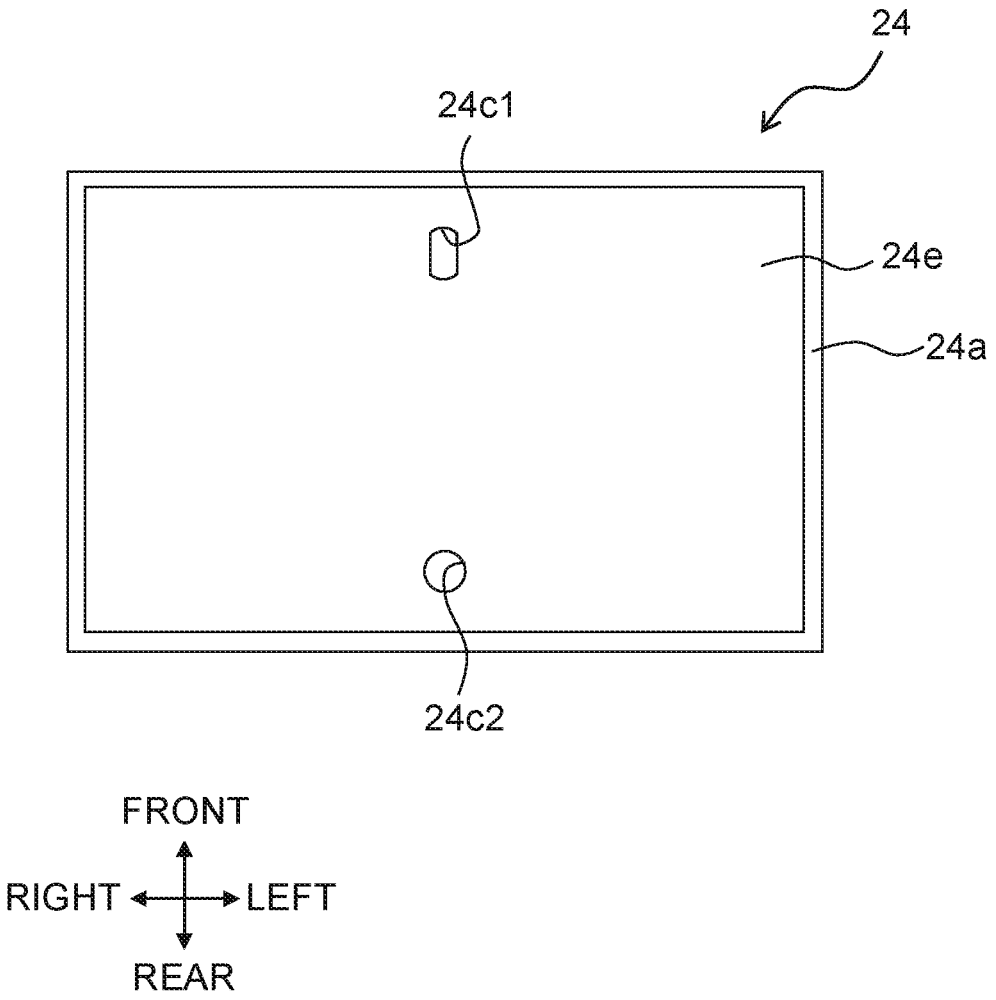
FIG. 8 is a bottom view of a body 24.
Figure 9:
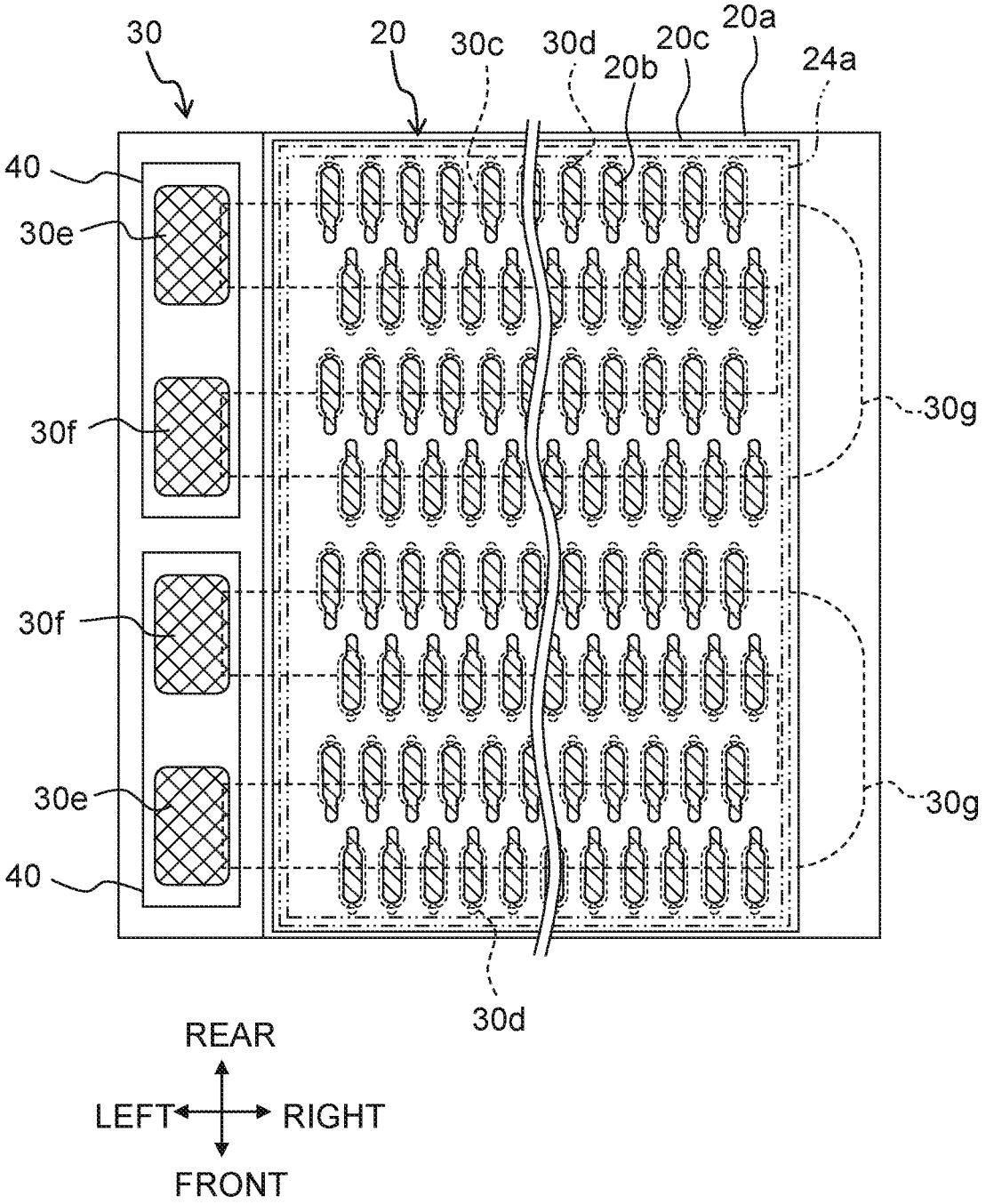
FIG. 9 is a schematic plan view of a convex part 24*a*, the actuator 20, and the channel member 30.

As depicted in FIGS. 5 and 8, an annular-shaped convex part 24*a* projecting downward is provided on a circumferential edge part of the bottom surface of the body 24. As depicted in FIG. 9, the convex part 24*a* makes contact with a part, of the upper surface of the actuator 20, which surrounds the plurality of individual electrodes 20*b*, via the COF 22. The convex part 24*a* makes contact with a circumferential or periphery edge part, of the upper surface of the actuator 20, via the COF 22.

The above-described annular-shaped joining member 23 is arranged between the convex part 24*a* and the COF 22, and the convex part 24*a* is attached to the COF 22 with the joining member 23. A reinforcement bump is formed between the COF 22 and the actuator 20, so as to firmly fix the actuator 20 and the COF 22 with each other. The reinforcing bump is arranged in a part, of the COF 22, which is pressed by the convex part 24*a*.

The channel member 30 includes two supply ports 30*e* to which the liquid is supplied. The two supply ports 30*e* are arranged side by side in the front-rear direction in a left edge part of the channel member 30. Two discharge ports 30*f* which discharge the liquid are arranged side by side in the front-rear direction in the left edge part of the channel member 30, at a location between the two supply ports 30*e*. As depicted in FIG. 9, a left portion of the convex part 24*a* is arranged between the supply and discharge ports 30*e*, 30*f* and individual electrodes 20*b* which are located at the leftmost end among the plurality of individual electrodes 20*b*. Note that a filter 40 may be arranged on the openings of the supply and discharge ports 30*e* and 30*f* so as to straddle or cover these openings.

One supply port 30*e* included in the supply ports 30*e* is connected or linked to one discharge port 30*f* which is included in the discharge ports 30*f* and which is adjacent to the one supply port 30*e* by a common channel 30*g* having a U-shape in a plan view. The common channel 30*g* is formed in the inside of the channel member 30 and is connected to or communicated with the respective pressure chambers 30*c*.

Further, the other supply port 30*e* included in the supply port 30*e* is connected to the other discharge port 30*f* which is included in the discharge ports 30*f* and which is adjacent to the other supply port 30*e* via another common channel 30*g* having a U-shape in a plan view. The another common channel 30*g* is also formed in the inside of the channel member 30 and is communicated with the respective pressure chambers 30*c*.

The ink supplied from the ink tank to the supply ports 30*e* passes through the common channels 30*g* to reach the pressure chambers 30*c*. The controller 7 applies a voltage between the common electrode 20*d* and the individual electrodes 20*b* to drive the piezoelectric layer 20*c* so as to vibrate the vibration plate 30*b*. Due to the vibration of the vibration plate 30*b*, the pressure inside the pressure chambers 30*c* becomes to be a positive pressure to thereby jet or discharge the ink from the nozzles 30*d*, and the pressure inside the pressure chambers 30*c* becomes to be a negative pressure to thereby supply the ink from the common channels 30*g* to the pressure chambers 30*c*.

The ink (a portion of the ink) which is not supplied to the pressure chambers 30*c* passes through each of the common channels 30*g* and moves along a front edge part or a rear edge part of the channel member 30. Afterwards, the unsupplied part of the ink makes a U-turn at a right edge part of the channel member 30 and moves through a central part in the front-rear direction of the channel member 30 and reaches the discharge ports 30*f*. The ink discharged from the discharge ports 30*f* returns to the ink tank and is supplied again to the supply ports 30*e*. During a printing operation of discharging the ink from the nozzles 30*d* performed by the liquid discharge apparatus 11, the ink inside the common channel 30*g* is circulated from the supply ports 30*e* toward the discharge ports 30*f*.

The heat in the body 24 is transferred or conducted to a circumferential edge part of the channel member 30 via the convex part 24*a*, and is conducted from the circumferential edge part to a central part of the channel member 30 to thereby heat the channel member 30 as a whole. Further, the left part of the convex part 24*a* is a slender part elongated in the front-rear direction and is arranged between the supply and discharge ports 30*e*, 30*f* and the individual electrodes 20*b* which are located at the leftmost end among the plurality of individual electrodes 20*b*. Namely, since the convex part 24*a* is arranged in the vicinity of the common channels 30*g*, it is possible to conduct the heat of the heating member 28 immediately to the ink flowing through the common channels 30*g*, to thereby realize a precise feedback control. Further, since the heating member 28 is arranged on the COF 22, it is possible to reduce the dimension or size of the liquid discharge apparatus 11 in the longitudinal direction of the common channels 30*g*, as compared with such a case that the heating member 28 is arranged at the outside of the COF 22.

<Modification>

Figure 10:
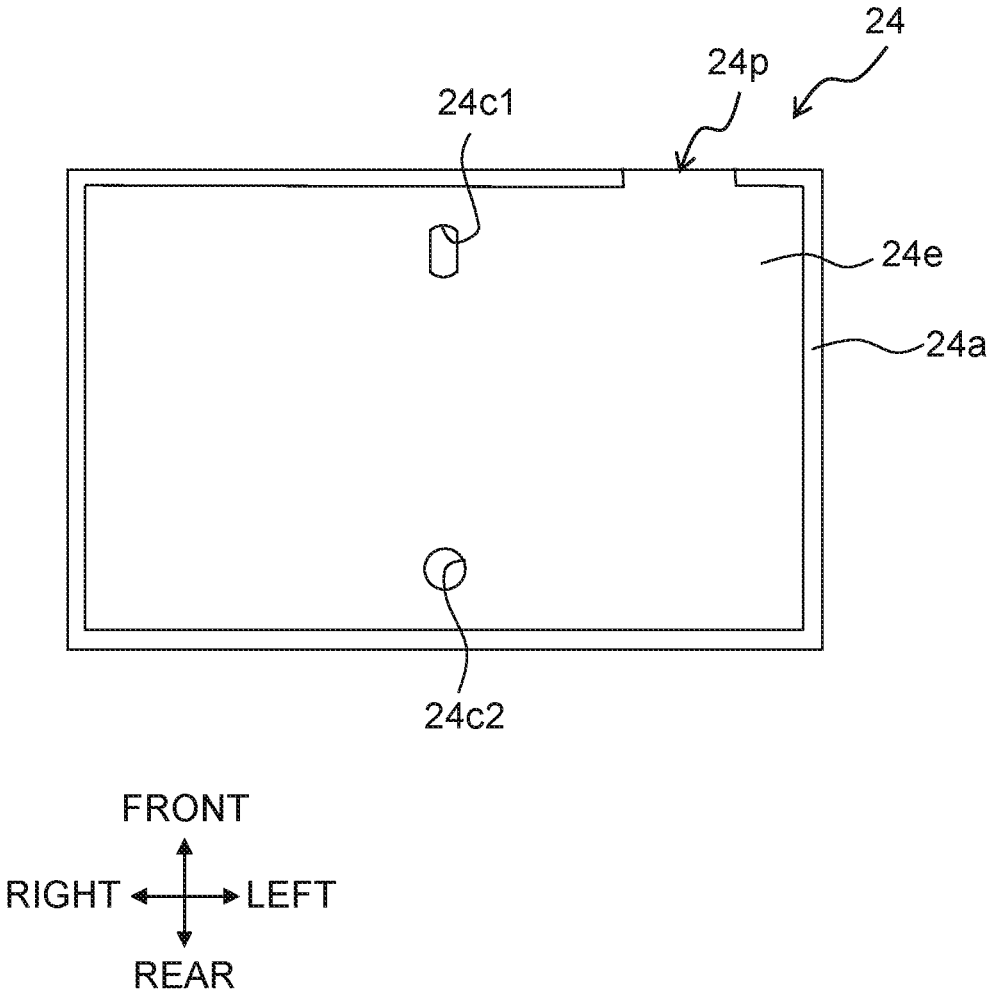
FIG. 10 is a bottom view of a body 24 according to a first modification.
Figure 11:
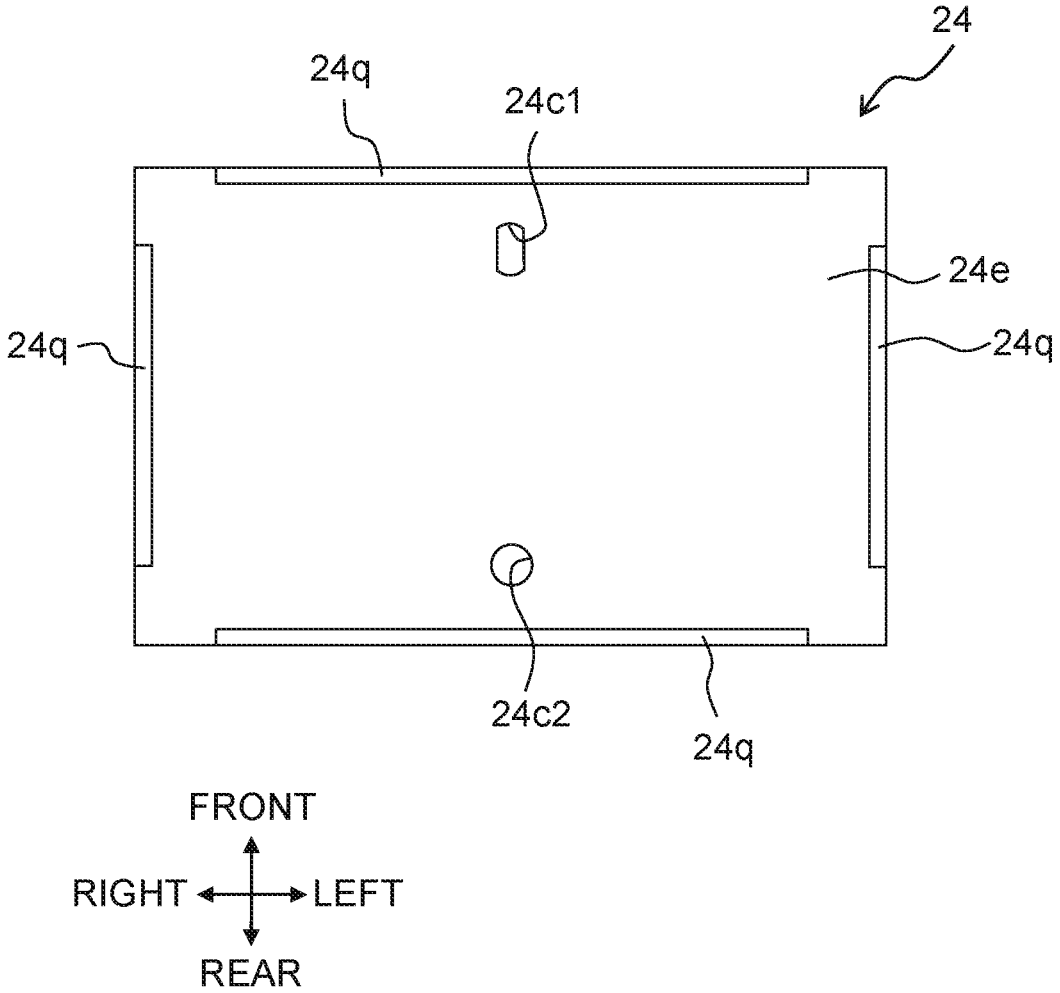
FIG. 11 is a bottom view of a body 24 according to a second modification.

With reference to FIG. 10, an explanation will be given about a first modification wherein a part of the configuration of the first embodiment is changed or modified. Further, with reference to FIG. 11, an explanation will be given about a second modification wherein a part of the configuration of the first embodiment is modified. As depicted in FIG. 10, a notch or an opening 24*p* may be provided in a part of the convex part 24*a*. With the notch or opening 24*p*, it is possible to improve the air permeability in a space wherein the plurality of bumps joining the plurality of respective individual electrodes 20*b* to the COF 22 are arranged. Further, the convex part 24*a* is not limited to being a single convex part 24*a*. As depicted in FIG. 11, for example, a plurality of convex parts 24*q* may be provided. In such a case also, a left-side convex part 24*q* among the plurality of convex parts 24*q* is a slender convex part 24*q* elongated in the front-rear direction and is arranged between the supply and discharge ports 30*e*, 30*f* and the individual electrodes 20*b* which are located at the leftmost end among the plurality of individual electrodes 20*b*. By allowing the plurality of convex parts 24*q* to make contact with a plurality of parts or locations of the channel member 30, the heat is conducted to the channel member 30 at the plurality of locations thereof, thereby making it possible to easily heat the channel member 30 as a whole in a uniform manner.

Figure 12:
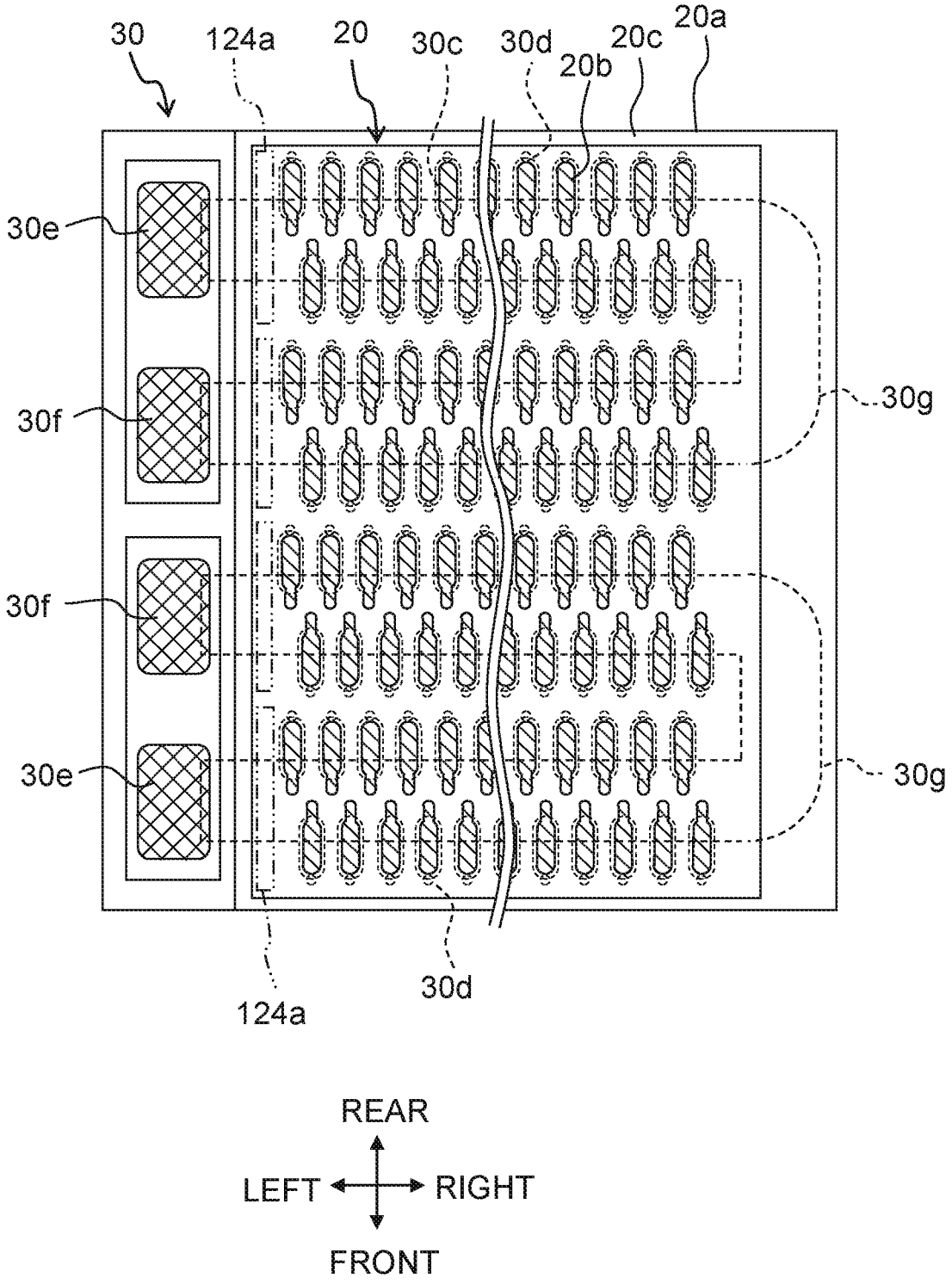
FIG. 12 is a schematic plan view of a first convex part, a second convex part, an actuator, and a channel member according to a third modification.

With reference to FIG. 12, an explanation will be given about a third modification wherein a part of the configuration of the first embodiment is modified. As depicted in FIG. 12, the heating member 28 may be provided with a plurality of convex parts 124*a*, rather than the convex part 24*a*. Each of the plurality of convex part 124*a* is a slender convex part 124*a* elongated in the front-rear direction and is arranged between one of the supply port 30*e* and individual electrodes 20*b* which are located at the leftmost end among the plurality of individual electrodes 20*b*, or between one of the discharge ports 30*e*, and individual electrodes 20*b* which are located at the leftmost end among the plurality of individual electrodes 20*b*. A width in the front-rear direction of each of the convex parts 124*a* is longer than that of the common channel 30*g*, and is provided to cross the common channel 30*g* in the front-rear direction.

Note that is it is allowable to arrange each of the plurality of convex parts 124*a* only between one of the supply ports 30*e* and the individual electrodes 20*b* which are located at the leftmost end among the plurality of individual electrodes 20*b*. In such a case, the ink supplied from the supply ports 30*e* is heated; the heated ink flows through the common channels 30*g* toward the discharge ports 30*f*, respectively, and thus the channel member 30 as a whole is heated. Alternatively, it is allowable to provide a single convex part 124*a*. Note that in the liquid discharge apparatus 11 of the present embodiment, it is explained that the ink inside the common channels 30*g* is allowed to flow from the supply ports 30*e* toward the discharge ports 30*f* during the printing operation. However, in such a case that a total amount of the ink discharged from the plurality of nozzles 30*d* per unit time becomes great, a flow of the ink from the discharge ports 30*f* toward the common channels 30*g* occurs in some cases. In the present embodiment, even in a case that such a flow of the ink occurs, the temperature of the ink inside the common channels 30*g* can be adjusted at an appropriate temperature, owning to the presence of the convex part(s) 124*a* each of which is arranged between one of the discharge ports 30*f* and the individual electrodes 20*b* located at the leftmost end among the plurality of individual electrodes 20*b*.

Figure 13:
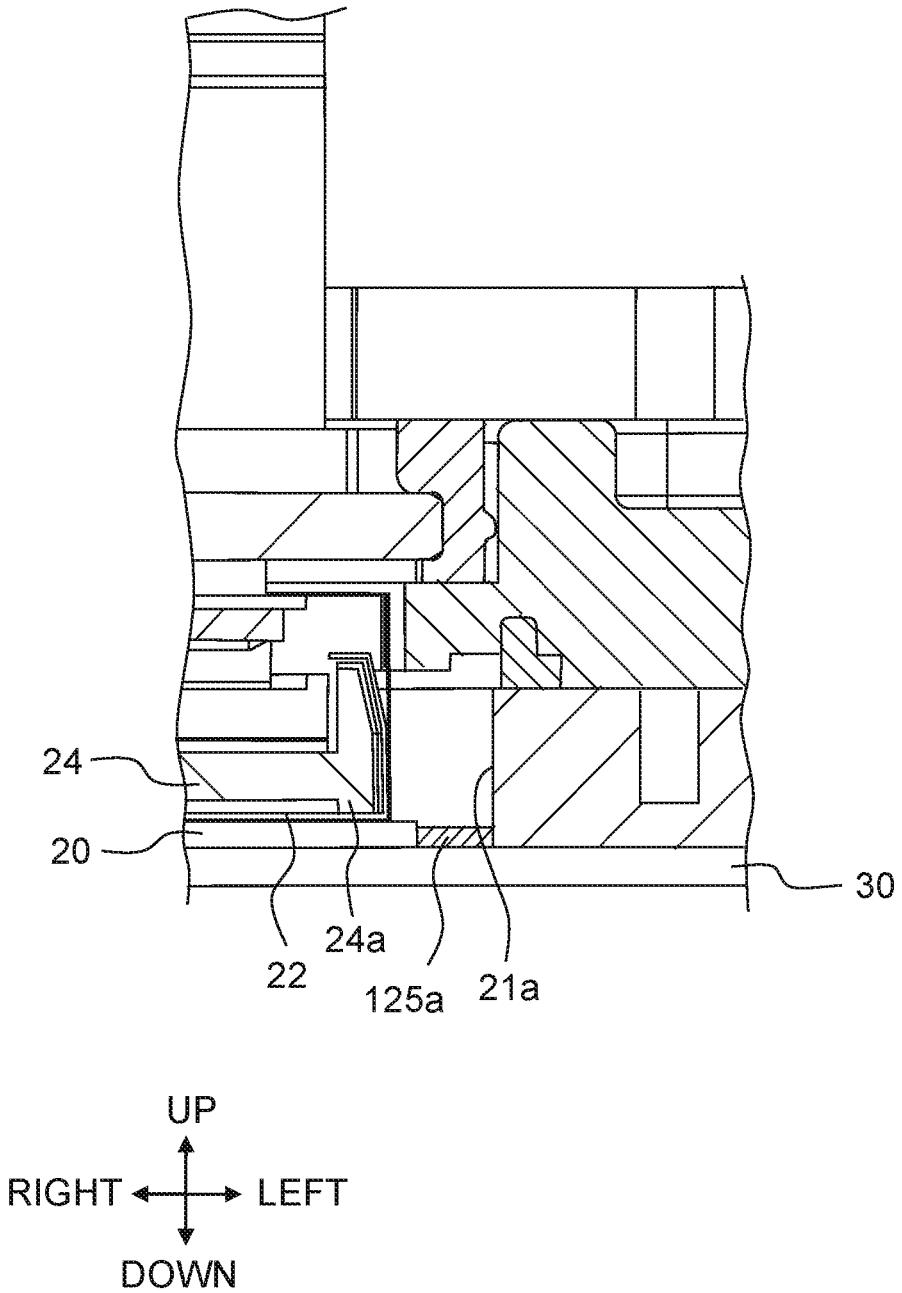
FIG. 13 is a partially enlarged vertical cross-sectional view of a liquid discharge apparatus 11 according to a fourth modification.

With reference to FIG. 13, an explanation will be given about a fourth modification wherein a part of the configuration of the first embodiment is modified. As depicted in FIG. 13, it is allowable to use a film heater 125*a* which directly makes contact with the channel member 30, rather than the heating member 28 provided with the film heater 25 and the body 24. The film heater 125*a* has a slender shape elongated in the front-rear direction, and is arranged at a location between, in the left-right direction, the supply ports 30*e* and a left end part of the actuator 20. By allowing the film heater 125*a* to make contact with the channel member 30, it is possible to enhance the efficiency in conducting the heat to the ink.

Figure 14:
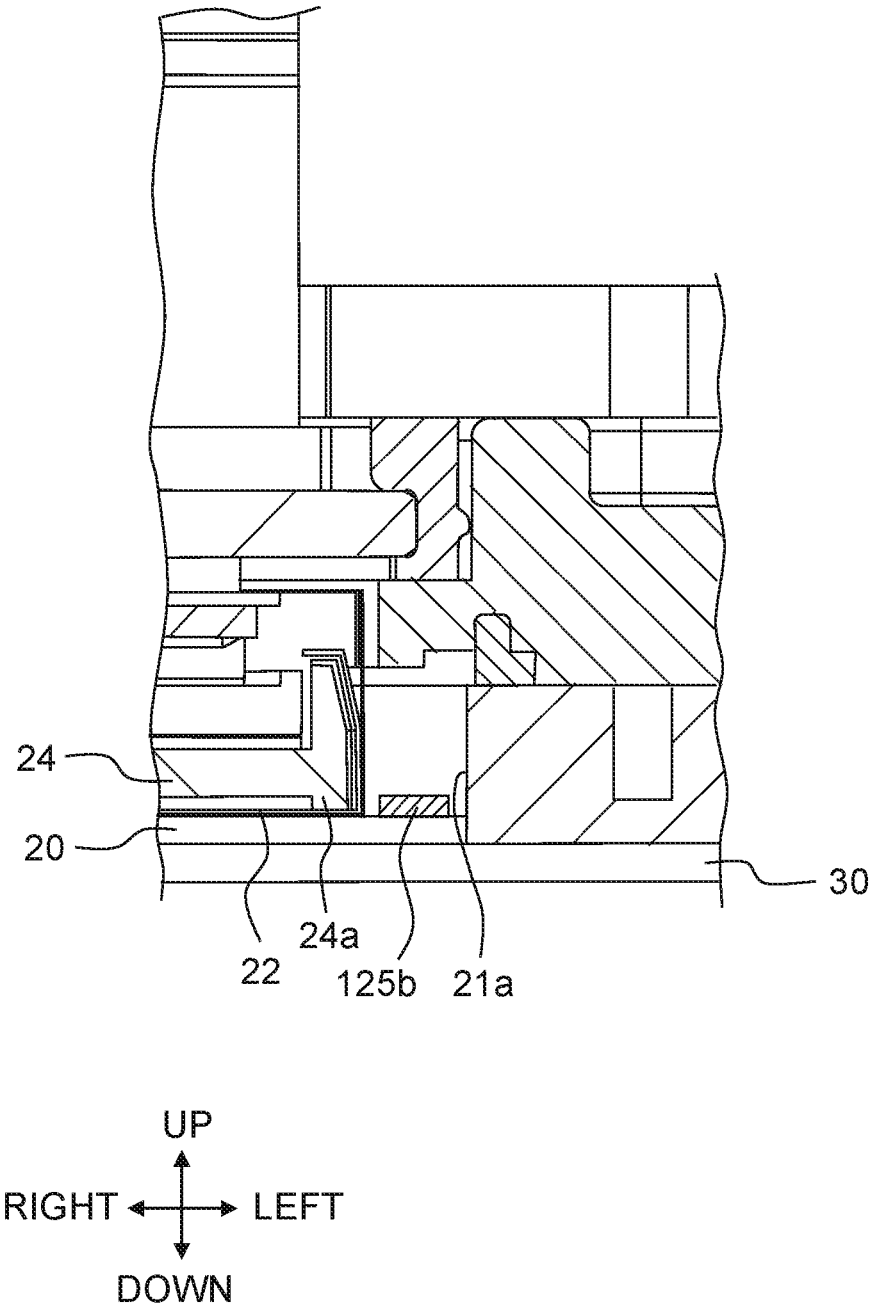
FIG. 14 is a partially enlarged vertical cross-sectional view of a liquid discharge apparatus 11 according to a fifth modification.

With reference to FIG. 14, an explanation will be given about a fifth modification wherein a part of the configuration of the first embodiment is modified. As depicted in FIG. 14, it is allowable to use a film heater 125*b* which directly makes contact with the actuator 20, rather than the heating member 28. The film heater 125*b* has a slender shape elongated in the front-rear direction, and is arranged at a location between, in the left-right direction, the supply ports 30*e* and a left end part of the COF 22. By allowing the film heater 125*a* to make contact with the actuator 20, it is possible to enhance the efficiency in conducting the heat to the ink, as compared with a case wherein the heating member 28 is allowed to make contact with the actuator 22 via the COF 22; and it is possible to reduce the dimension in the longitudinal direction of the common channel 30*g*, as compared with a case wherein the heating member 28 is allowed to directly make contact with the channel member 30.

Second Embodiment

Figure 15:
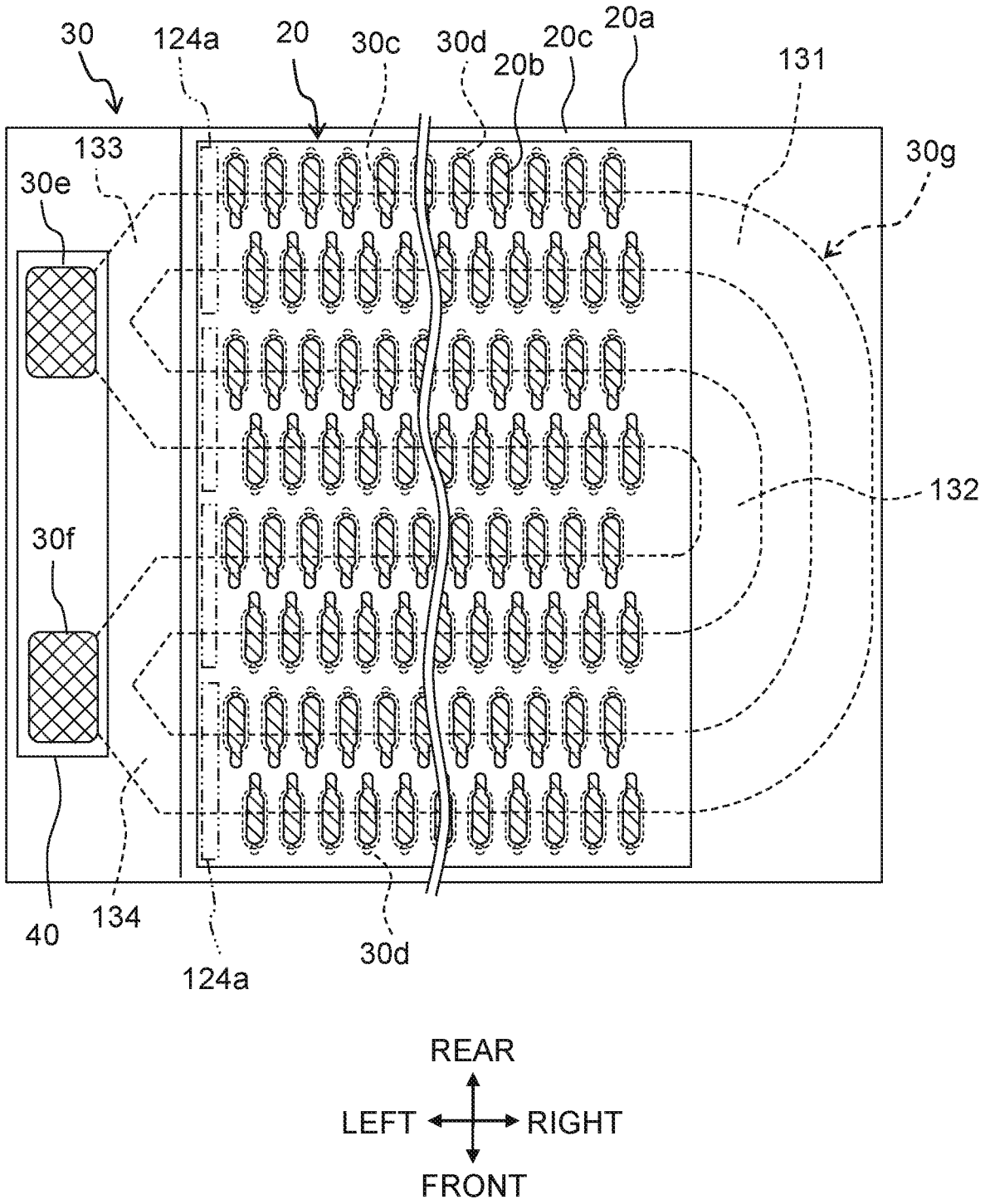
FIG. 15 is a schematic plan view of an actuator 20 and a channel member 30 according to a second embodiment.

In the following, an explanation will be given about a printer according to a second embodiment, with reference to FIG. 15. As depicted in FIG. 15, one piece of the supply port 30*e* and one piece of the discharge port 30*f* are formed in a left part of the channel member 30. Note that corresponding to the number of each of the supply port 30*e* and the discharge port 30*f*, two pieces of the through hole 21*b* and two pieces of the through hole 32*b* are provided as well.

A common channel 30*g* of the channel member 30 is provided with a first channel 131 having a U-shape in a plan view, and a second channel 132 having a U-shape in a plan view. The second channel 132 is arranged in the inside of the first channel 131, and the first and second channels 131 and 132 are arranged to be parallel to each other. An end part of the first channel 131 and an end part of the second channel 132 are connected to a branched channel 133 which is branched into two channels from the supply port 30*e*; the other end part of the first channel 131 and the other end part of the second channel 132 are connected to a branched channel 134 which is branched into two channels from the discharge port 30*f*.

The heating member 28, for example, the convex part 124*a*, is provided on each of the one end part of the first channel 131, the one end part of the second channel 132, the other end part of the first channel 131 and the other end part of the second channel 132. The heat is conducted directly from the convex part 124*a* to each of the first and second channels 131 and 132, and the heat is efficiently conducted to the ink flowing through the first and second channels 131 and 132. Note that it is allowable to provide a film heater directly adhered to the upper surface of the actuator 20, rather than the convex parts 124*a*.

Third Embodiment

Figure 16:
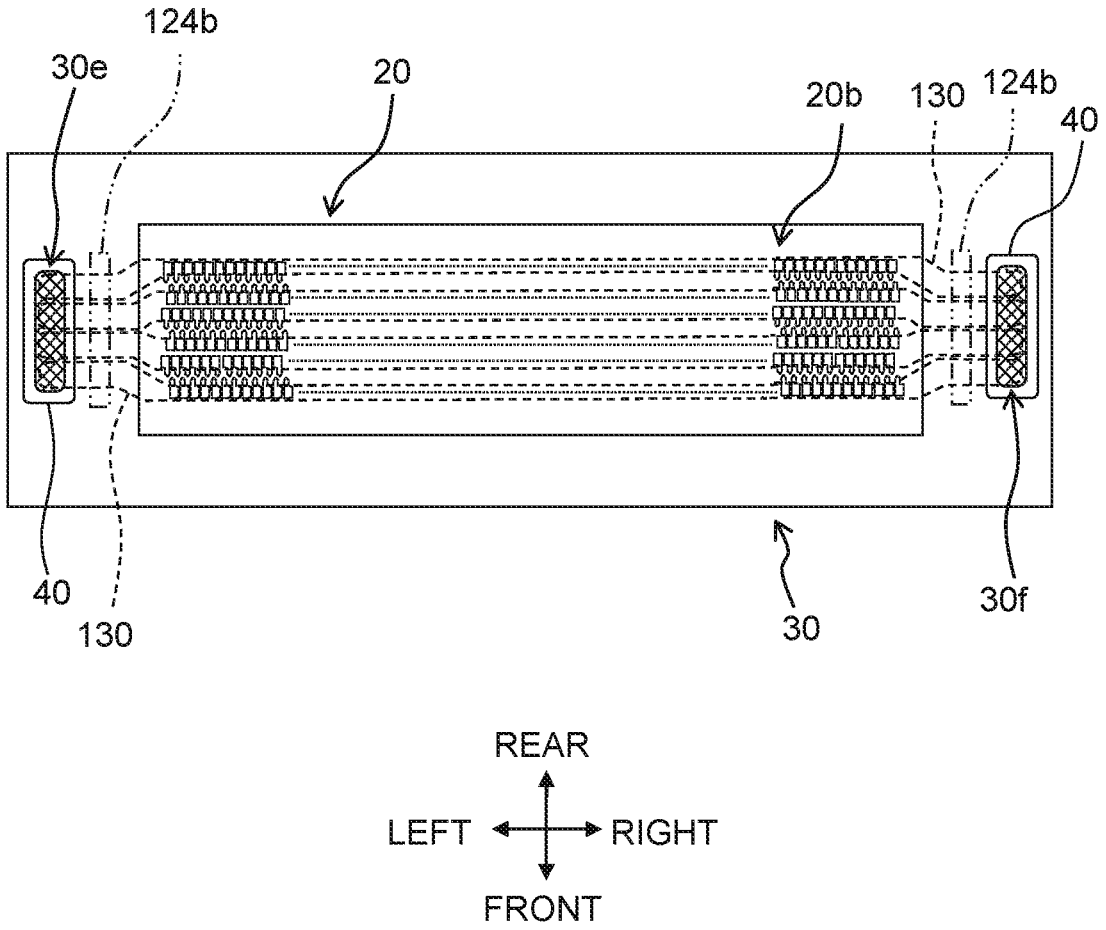
FIG. 16 is a schematic plan view of an actuator and a channel member 30 according to a third embodiment.

In the following, an explanation will be given about a printer according to a third embodiment, with reference to FIG. 16. As depicted in FIG. 16, six pieces of an array of a plurality of individual electrodes 20*b* aligned in the left-right direction are provided and arranged side by side in the front-rear direction. One piece of the supply port 30*e* having a slender shape elongated in the front-rear direction is arranged at a left end part of the channel member 30, and one piece of the discharge port 30*f* having a slender shape elongated in the front-rear direction is arranged in a right end part of the channel member 30. The channel member 30 is provided with four common channels 130 elongated in the left-right direction; each of the four common channels 130 connects the supply port 30*e* and the discharge port 30*f*. A common channel 130 which is located on the frontmost side among the four common channels 130 corresponds to a frontmost-side array of the individual electrodes 20*b* which is located on the frontmost side among the six arrays of the plurality of individual electrodes 20*b*; a common channel 130 which is located second from the front side among the four common channels 130 corresponds two arrays of the individual electrodes 20*b* which are second and third arrays from the front side among the six arrays of the plurality of individual electrodes 20*b*; a common channel 130 which is located third from the front side among the four common channels 130 corresponds two arrays of the individual electrodes 20*b* which are fourth and fifth arrays from the front side among the six arrays of the plurality of individual electrodes 20*b*; and a common channel 130 which is located on the rearmost side among the four common channels 130 corresponds to a rearmost-side array of the individual electrodes 20*b* which is located on the rearmost side among the six arrays of the plurality of individual electrodes 20*b*.

Two film heaters 124*b*, as a heating member, are arranged, respectively, between the supply port 30*e* and individual electrodes 20*b* arranged on the leftmost side among the plurality of individual electrodes 20*b* and between the discharge port 30*f* and individual electrodes 20*b* arranged on the rightmost side among the plurality of individual electrodes 20*b*. Width in the front-rear direction of each of the film heaters 124*b* is longer than the total of widths in the front-rear direction of the four common channels 130. Each of the film heaters 124*b* is arranged to cross the four common channels 130 in the front-rear direction.

Note that it is allowable to arrange the film heater 124*b* at only one of the location between the supply port 30*e* and the individual electrodes 20*b* located on the leftmost side and the location between the discharge port 30*f* and the individual electrodes 20*b* located on the rightmost side. Since the film heater 124*b* is arranged to straddle over the four common channels 130, the heat of the film heater 124*b* is conducted efficiently to the ink flowing through the four common channels 130. Note that in the third embodiment, the film heater(s) 124*b* are adhered directly on the upper surface of the channel member 130.

Fourth Embodiment

Figure 17:
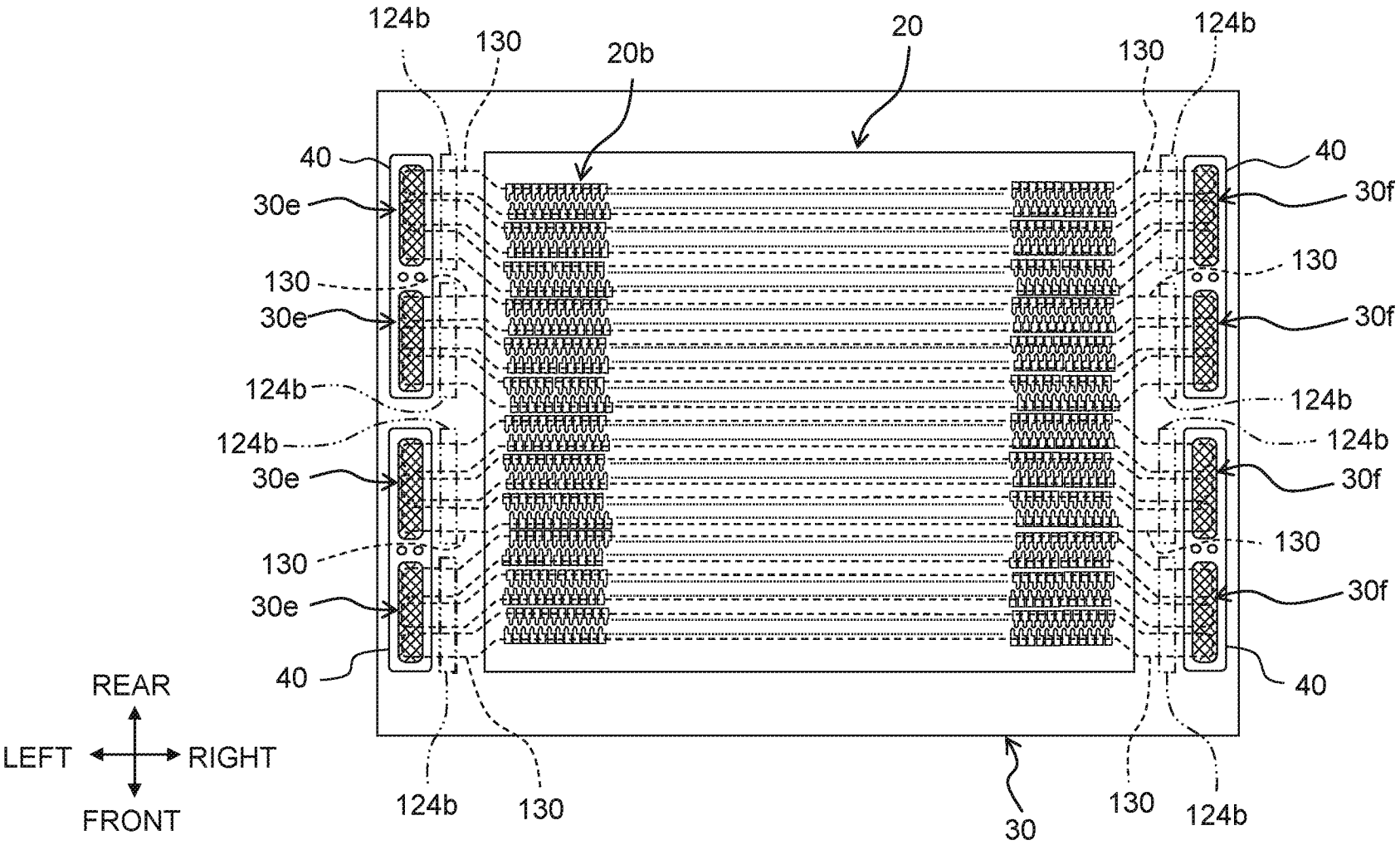
FIG. 17 is a schematic plan view of an actuator 20 and a channel member 30 according to a fourth embodiment.

In the following, an explanation will be given about a printer according to a fourth embodiment, with reference to FIG. 17. As depicted in FIG. 17, an even number of pieces of an array of a plurality of individual electrodes 20*b* aligned in the left-right direction are provided. The even number of pieces of the array of the plurality of individual electrodes 20*b* are arranged side by side in the front-rear direction. A plurality of supply ports 30*e* are aligned side by side at a left end part of the channel member 30, and a plurality of discharge ports 30*f* are aligned side by side a right end part of the channel member 30. The channel member 30 is provided with a plurality of common channels 130 extending in the left-right direction. The plurality of common channels 130 connect the plurality of supply ports 30*e* and the plurality of discharge ports 30*f*, respectively. One piece of the common channels 130 corresponds to two pieces of the even number of pieces of the arrays of the individual electrodes 20*b*.

Film heaters 124*b*, as a heating member, are arranged such that each of the film heaters 124*b* is arranged between supply ports 30*e* among the plurality of supply ports 30*e* and individual electrodes 20*b* arranged on the leftmost side among the plurality of individual electrodes 20*b*, or between discharge ports 30*f* among the plurality of discharge ports 30*f* and individual electrodes 20*b* arranged on the rightmost side among the plurality of individual electrodes 20*b*. For example, as depicted in FIG. 17, one piece of the film heaters 124*b* is arranged corresponding to three pieces of the common channels 130; width in the front-rear direction of each of the film heaters 124*b* is longer than the total of widths in the front-rear direction of the three common channels 130. Each of the film heaters 124*b* is arranged to cross the three common channels 130 in the front-rear direction.

Each of the film heaters 124*b* makes contact with the respective three common channels 130, and the heat of the heating member 28 is conducted efficiently to the ink flowing through the respective three common channels 130. Note that it is allowable to arrange the film heaters 124*b* at only one of the location between the supply ports 30*e* and the individual electrodes 20*b* located on the leftmost side and the location between the discharge ports 30*f* and the individual electrodes 20*b* located on the rightmost side. Note further that it is allowable to allow the film heaters 124*b* to make contact with the actuator 20 directly or via the COF 22.

Fifth Embodiment

Figure 18:
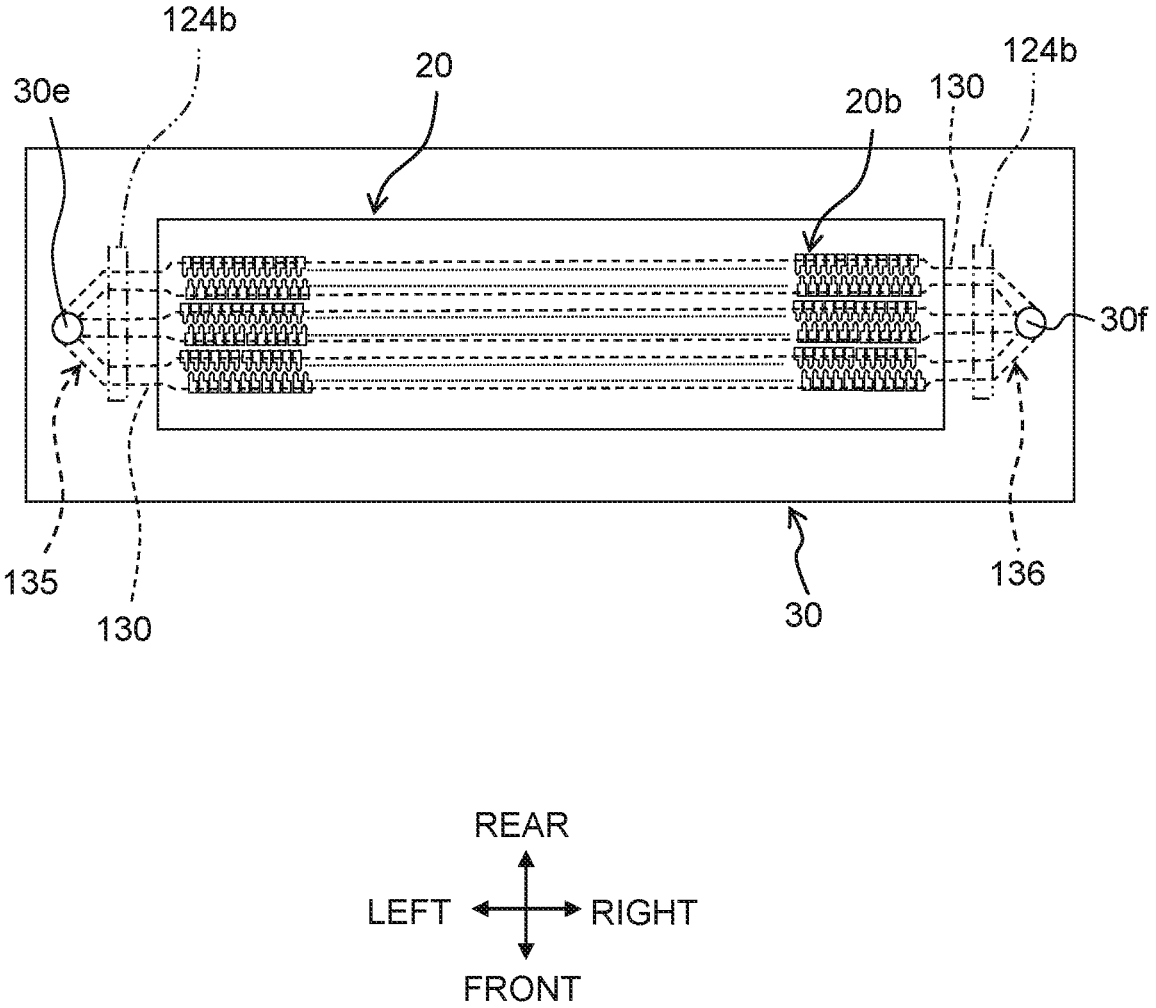
FIG. 18 is a schematic plan view of an actuator 20 and a channel member 30 according to a fifth embodiment.

In the following, an explanation will be given about a printer according to a fifth embodiment, with reference to FIG. 18. As depicted in FIG. 18, there are provided a plurality of arrays of a plurality of individual electrodes 20 aligned in the left-right direction. The plurality of arrays of the plurality of individual electrodes 20 are arranged side by side in the front-rear direction. One piece of a supply port 30*e* is provided on a left end part of the channel member 30, and one piece of a discharge port 30*f* is provided on a right end part of the channel member 30. The channel member 30 is provided with a plurality of common channels 130 extending in the left-right direction. Left end parts, respectively, of the plurality of common channels 130 are connected to a branched channel 135 which is branched into a plurality of channels from one piece of the supply port 30*e*; right end parts, respectively, of the plurality of common channels 130 are connected to a branched channel 136 which is branched into a plurality of channels from one piece of the discharge port 30*f*.

Film heaters 124*b*, as a heating member, are arranged, respectively, between the supply port 30*e* and individual electrodes 20*b* arranged on the leftmost side among the plurality of individual electrodes 20*b* and further between the discharge port 30*f* and individual electrodes 20*b* arranged on the rightmost side among the plurality of individual electrodes 20*b*. For example, as depicted in FIG. 18, the film heaters 124*b* are arranged with respect to three pieces of the common channels 130; width in the front-rear direction of each of the film heaters 124*b* is longer than the total of widths in the front-rear direction of the three common channels 130. Each of the film heaters 124*b* is arranged to cross the three common channels 130 in the front-rear direction.

Note that it is allowable to arrange the film heater 124*b* at only one of the location between the supply port 30*e* and the individual electrodes 20*b* located on the leftmost side and the location between the discharge port 30*f* and the individual electrodes 20*b* located on the rightmost side. The film heaters 124*b* are arranged to straddle over the respective common channels 130, and the heat of the film heaters 124*b* is conducted efficiently to the ink flowing through the respective common channels 130. Note that in the fifth embodiment, the film heaters 124*b* are adhered directly on the upper surface of the channel member 30.

Sixth Embodiment

Figure 19:
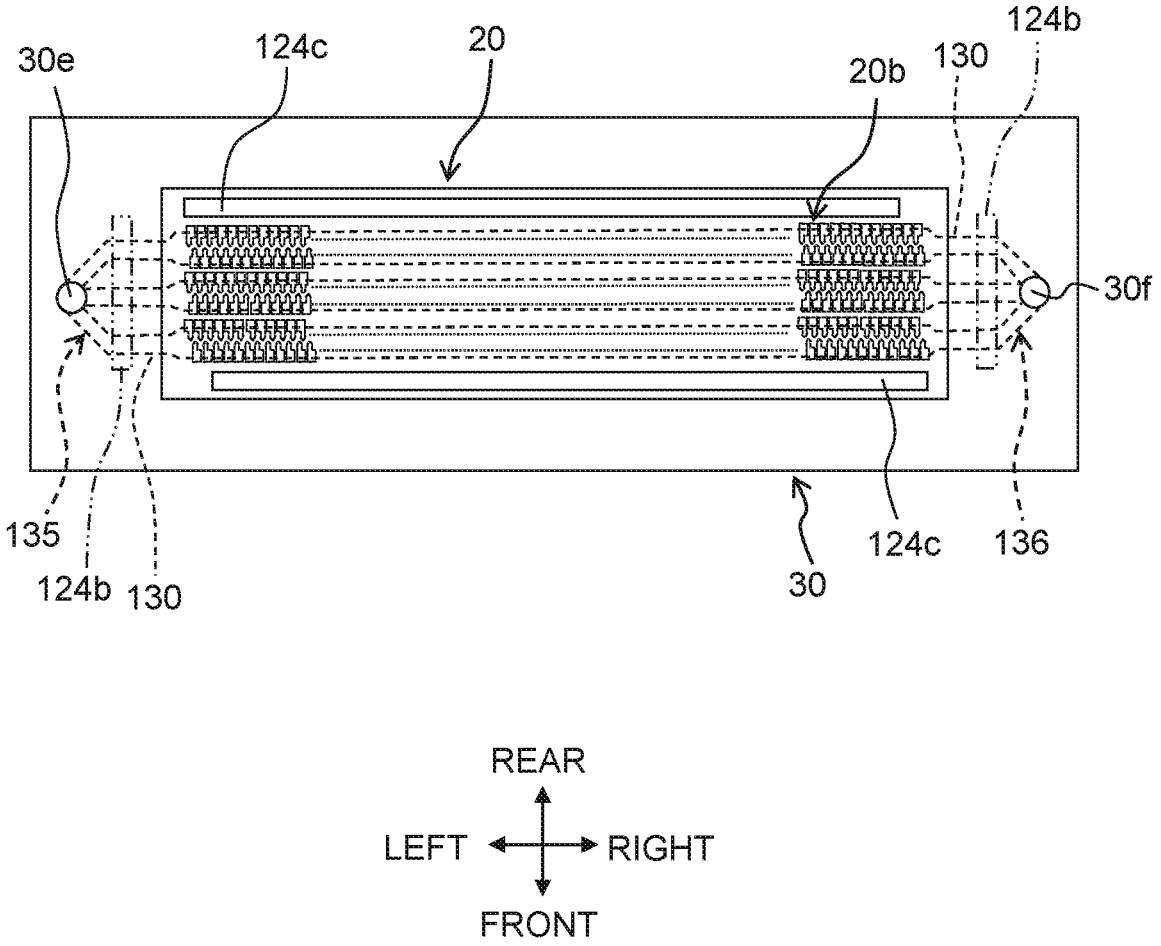
FIG. 19 is a schematic plan view of an actuator 20 and a channel member 30 according to a sixth embodiment.

In the following, an explanation will be given about a printer according to a sixth embodiment, with reference to FIG. 19. A liquid discharge apparatus according to the sixth embodiment has a similar configuration as that of the fifth embodiment, except for a film heater 124*c*. Accordingly, only the film heater 124*c* is described in the following explanation. As depicted in FIG. 19, the film heater 124*c* having a slender shape elongated in the left-right direction is arranged on the upper surface of the actuator 20. By providing the film heater 124*c* elongated in the left-right direction, in addition to the film heater 124*b* elongated in the front-rear direction, the heat can be easily conducted uniformly to the channel member 30.

Note that the arrangement of the contact position at which the discharging member and the heating member make contact with each other according to the above-described first to sixth embodiments is applicable also to a thermal ink-jet printer. Further, the liquid discharge apparatus according to the above-described first to sixth embodiments has been explained as being configured to supply the ink from the supply port 30*e* and to exhaust the non-discharged ink from the discharge port 30*f*. It is allowable, however, that the above-described liquid discharge apparatus is changed to such a liquid discharge apparatus wherein the opening explained as the discharge port 30*f* is changed to a supply port via which the ink is supplied to the common channel; and the ink is supplied via supply ports provided on both end parts, respectively, of the common channel. Further, it is allowable to arrange the heating member at locations each of which is between one of the supply ports and the individual electrodes such that the discharging member and the heating member make contact with each other.

The embodiments disclosed herein are examples in all aspects, and are to be considered as not limiting or restricting the embodiments disclosed herein in any way. The technical features described in the respective embodiments can be combined with one another.

What is claimed is:

1. A liquid discharge apparatus comprising:

a head including:

a plurality of individual electrodes arranged side by side in a first direction;

a plurality of individual channels arranged side by side in the first direction;

a plurality of nozzles arranged side by side in the first direction;

a common channel communicating with the plurality of individual channels;

an actuator provided with a piezoelectric layer that is driven by a voltage applied to the plurality of individual electrodes;

a channel member having the common channel; and an opening communicating with the common channel;

a heater which makes contact with the head; and a film arranged between the actuator and the heater, wherein a first individual electrode, which is included in the plurality of individual electrodes and which is located at an end in the first direction, and the opening are apart from each other in the first direction; and the heater includes a contacting part which makes contact with the actuator of the head, via the film, at a location between the first individual electrode and the opening in the first direction.

2. The liquid discharge apparatus according to claim 1, wherein the film is a COF.

3. The liquid discharge apparatus according to claim 1, wherein the common channel extends in the first direction, the contacting part of the heater extends in a second direction crossing the first direction in a plan view, and the contacting part of the heater overlaps with the common channel in a third direction orthogonal to two directions which are the first and second directions.

4. The liquid discharge apparatus according to claim 3, wherein a length in the second direction of the contacting part of the heater is longer than a length in the second direction of the common channel.

5. The liquid discharge apparatus according to claim 1, wherein the head is provided with another opening different from the opening, the common channel connects the opening and the another opening, the heater is provided with another part different from the contacting part, and the another part of the heater makes contact with the head at a location between the another opening and the plurality of individual electrodes.

6. The liquid discharge apparatus according to claim 1, further comprising another heater different from the heater, wherein the head is provided with another opening different from the opening, the common channel connects the opening and the another opening, and a part of the another heater makes contact with the head, at a location between the another opening and the plurality of individual electrodes.

7. The liquid discharge apparatus according to claim 6, wherein the opening and the another opening are arranged on one side in the first direction, and the common channel includes:

a first part extending from the opening toward the other side in the first direction;

a second part extending from the another opening toward the other side in the first direction; and a third part connecting the first and second parts.

8. The liquid discharge apparatus according to claim 6, wherein the opening is arranged on one side in the first direction and the another opening is arranged on the other side in the first direction, and the common channel extends in the first direction.

9. The liquid discharge apparatus according to claim 5, wherein the opening and the another opening are arranged on one side in the first direction, and the common channel includes:

a first part extending from the opening toward the other side in the first direction;

a second part extending from the another opening toward the other side in the first direction; and a third part connecting the first and second parts.

10. The liquid discharge apparatus according to claim 5, wherein the opening is arranged on one side in the first direction and the another opening is arranged on the other side in the first direction, and the common channel extends in the first direction.

11. The liquid discharge apparatus according to claim 1, wherein the heater is provided with another part different from the contacting part, and the another part is a part extending in the first direction.

12. The liquid discharge apparatus according to claim 1, further comprising another heater different from the heater, wherein the another heater makes contact with the head at a contacting part of the another heater, and the contacting part, of the another eater, extends in the first direction.

13. The liquid discharge apparatus according to claim 1, wherein the heater has a heating body and a heat conducting body, wherein heat conductivity of the heat conducting body is higher than heat conductivity of a part, in the head, which makes contact with the contacting part of the heater.

14. The liquid discharge apparatus according to claim 1, wherein the head is provided with another common channel different from the common channel, the common channel and the another common channel both communicate with the opening, and the common channel and the another common channel both extend in the first direction.

15. The liquid discharge apparatus according to claim 14, wherein the head includes:

a first branch channel communicating with the opening and branched from the opening; and a second branch channel communicating with the opening and branched from the opening, the common channel communicates with the opening via the first branch channel, and the another common channel communicates with the opening via the second branch channel.

16. The liquid discharge apparatus according to claim 14, wherein the contacting part of the heater extends in a second direction crossing the first direction in a plan view, and the contacting part of the heater includes a first part overlapping with the common channel in a third direction orthogonal to the first and second directions, and a second part overlapping with the another common channel in the third direction.

* * * * *